US009044840B2

(12) United States Patent
Feng et al.

(10) Patent No.: US 9,044,840 B2
(45) Date of Patent: Jun. 2, 2015

(54) SHEET FOR MOUNTING A WORKPIECE AND METHOD FOR MAKING THE SAME

(75) Inventors: Chung-Chih Feng, Kaohsiung (TW); I-Peng Yao, Kaohsiung (TW); Lyang-Gung Wang, Kaohsiung (TW); Chun-Ta Wang, Kaohsiung (TW); Hsin-Ru Song, Kaohsiung (TW)

(73) Assignee: SAN FANG CHEMICAL INDUSTRY CO., LTD., Kaohsiung (TW)

( * ) Notice: Subject to any disclaimer, the term of this patent is extended or adjusted under 35 U.S.C. 154(b) by 895 days.

(21) Appl. No.: 13/091,438

(22) Filed: Apr. 21, 2011

(65) Prior Publication Data

US 2012/0094584 A1 Apr. 19, 2012

(30) Foreign Application Priority Data

Oct. 13, 2010 (TW) ..... 99134965 A

(51) Int. Cl.
*B24B 37/00* (2012.01)
*B24B 37/30* (2012.01)

(52) U.S. Cl.
CPC ..... *B24B 37/30* (2013.01)

(58) Field of Classification Search
CPC ..... B24B 37/30
USPC ..... 277/312
See application file for complete search history.

(56) References Cited

U.S. PATENT DOCUMENTS 6,524,176 B1 * 2/2003 Cheng et al. ..... 451/526
6,884,156 B2 * 4/2005 Prasad et al. ..... 451/533
7,229,337 B2 * 6/2007 Lim et al. ..... 451/6
8,066,552 B2 * 11/2011 Duboust et al. ..... 451/288
8,083,570 B2 * 12/2011 String et al. ..... 451/6
8,557,376 B2 * 10/2013 Matsumura et al. ..... 428/316.6
2002/0115385 A1 * 8/2002 Misra et al. ..... 451/41
2008/0268223 A1 10/2008 Feng et al.
2009/0252949 A1 10/2009 Feng et al.
2010/0227118 A1 9/2010 Feng et al.

FOREIGN PATENT DOCUMENTS

CN 1802237 A 7/2006
CN 101298129 A 11/2008
TW 450874 8/2001
TW 200842962 11/2008

OTHER PUBLICATIONS

Office Action for CN Patent Application No. 201010530362.3 dated Jun. 6, 2013.

(Continued)

*Primary Examiner* — Mark Ruthkosky
*Assistant Examiner* — Christopher Polley
(74) *Attorney, Agent, or Firm* — WPAT, P.C.; Anthony King

(57) ABSTRACT

The present invention relates to a sheet for mounting a workpiece and a method for making the same. The method includes the steps of: (a) providing a sheet body having a top surface, a bottom surface, at least one side surface and a plurality of pores, wherein some of the pores open at the side surface; and (b) sealing or narrowing the pores that open at the side surface. Since the pores that open at the side surface are sealed or narrowed, the slurry is prevented from entering into the interior of the sheet body. Therefore, the infiltration distance reaches a predetermined value slowly, thereby increasing the effective life of the sheet.

2 Claims, 4 Drawing Sheets

(56) References Cited

OTHER PUBLICATIONS

Office Action for TW Patent Application No. 10220969560 dated Jul. 23, 2013.
English Translation of Office Action for CN Patent Application No. 201010530362.3 dated Jun. 6, 2013.
English Translation of Abstract of CN 101298129.
English Translation of Abstract of CN 1802237.
English Translation of Office Action for TW Patent Application No. 10220969560 dated Jul. 23, 2013.
English Translation of Abstract of TW 200842962.
English Translation of Abstract of TW 450874.

* cited by examiner

SHEET FOR MOUNTING A WORKPIECE AND METHOD FOR MAKING THE SAME

BACKGROUND OF THE INVENTION

1. Field of the Invention

The present invention relates to a sheet for mounting a workpiece and a method for making the same, and more particularly to a sheet with sealed or narrowed side surface pores for mounting a workpiece and a method for making the same.

2. Description of the Related Art

Polishing generally refers to wear control for a preliminarily coarse surface by the process of chemical mechanical polishing (CMP), which involves evenly dispersing a slurry containing fine particles on a top surface of a polishing pad, placing a workpiece against the polishing pad and rubbing the workpiece repeatedly with a regular motion. The workpiece is an object such as a semiconductor, a storage medium substrate, an integrated circuit (IC), an LCD flat-panel glass, an optical glass, or a photoelectric panel. A sheet is used to carry and fix the workpiece in place, and the quality of the sheet directly influences the polishing effect of the workpiece.

FIG. 1 is a schematic view of a polishing device having a conventional sheet disclosed in U.S. Pat. No. 5,871,393. The polishing device 1 includes a lower base plate 11, a sheet 12, a workpiece 13, an upper base plate 14, a polishing pad 15, and a slurry 16. The lower base plate 11 is opposite to the upper base plate 14. The sheet 12 is adhered to the lower base plate 11 through a backing layer 17, and the sheet 12 is used for carrying and fixing the workpiece 13. The polishing pad 15 is fixed on the upper base plate 14 and faces the lower base plate 11, and is used for polishing the workpiece 13.

The operation mode of the polishing device 1 is as follows. First, the workpiece 13 is disposed on the sheet 12, and the workpiece 13 is mounted by the sheet 12. Next, the upper base plate 14 and the lower base plate 11 are rotated in opposite directions, and meanwhile the upper base plate 14 is moved downwards, such that the polishing pad 15 contacts the surface of the workpiece 13, and a polishing operation for the workpiece 13 may be performed by continuously supplementing the slurry 16 and using the polishing pad 15.

FIG. 2 is a schematic perspective view of a conventional sheet. The sheet 12 has a top surface 121, a bottom surface 122, at least one side surface 123, and a plurality of communicating pores 124. The bottom surface 122 is adhered to the lower base plate 11 through the backing layer 17, and the top surface 121 is used for carrying and fixing the workpiece 13. During the polishing process, the slurry 16 enters into the sheet 12, and infiltrates into a space between the workpiece 13 and the top surface 121 of the sheet 12 to form a trace 131. A distance between the trace 131 and a side edge of the workpiece 13 is defined as an infiltration distance D. Within the infiltration distance D, the mounting force between the workpiece 13 and the sheet 12 is weakened, such that the workpiece 13 cannot be polished to be flat. Therefore, when the infiltration distance D reaches a predetermined value (of about 1 cm or 2 cm), the life of the sheet 12 ends, and the sheet 12 must be replaced.

As the sheet 12 is a single unit formed by cutting, some of the pores 124 open at the side surface 123 and are exposed at the side surface 123, thus leading to the following disadvantage. During the polishing process, the slurry 16 will rapidly enter into the interior of the sheet 12 through the pores 124 that open at the side surface 123, and simultaneously rapidly infiltrate into the space between the workpiece 13 and the top surface 121 of the sheet 12. As a result, the infiltration distance D quickly reaches the predetermined value (of about 1 cm or 2 cm), thereby diminishing the effective life of the sheet 12, which must thus be replaced relatively frequently, incurring additional time and cost.

Therefore, it is necessary to provide an innovative and inventive sheet for mounting a workpiece and a method for making the same to solve the above problems.

SUMMARY OF THE INVENTION

The present invention is directed to a sheet for mounting a workpiece, which sheet includes a sheet body and a sealing material. The sheet body has a top surface, a bottom surface, at least one side surface, and a plurality of pores. Some of the pores open at the side surface, and the top surface is used for mounting a workpiece. The sealing material is located on the side surface to cover and seal the pores that open at the side surface.

The present invention further provides a sheet for mounting a workpiece, which sheet includes a sheet body. The sheet body includes a middle part and at least one peripheral part. The middle part has a top surface, a first thickness, and a first bulk density. The top surface is used for mounting a workpiece. The peripheral part is located at the periphery of the middle part. The peripheral part has a side surface, a second thickness, and a second bulk density. The second thickness is less than the first thickness, and the second bulk density is greater than the first bulk density.

The present invention further provides a method for making a sheeting for mounting a workpiece, which includes: (a) providing a sheet body having a top surface, a bottom surface, at least one side surface, and a plurality of pores, in which some of the pores open at the side surface, and the top surface is used for mounting a workpiece; and (b) sealing or narrowing the pores that open at the side surface.

In the present invention, the pores that open at the side surface are sealed or narrowed to prevent the slurry from entering into the sheet body during the polishing process. Thus, the infiltration distance reaches the predetermined value (of about 1 cm or 2 cm) slowly, thereby increasing the effective life of the sheet.

DETAILED DESCRIPTION OF THE INVENTION

Figure 1:
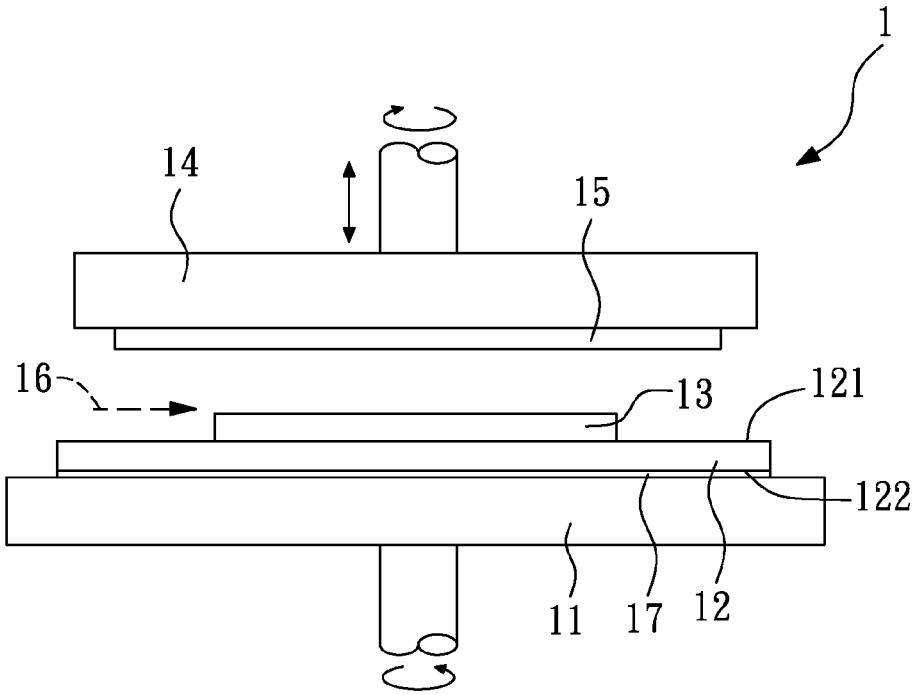
FIG. 1(Prior Art)
FIG. 1 is a schematic view of a polishing device having a conventional sheet disclosed in U.S. Pat. No. 5,871,393.
Figure 2:
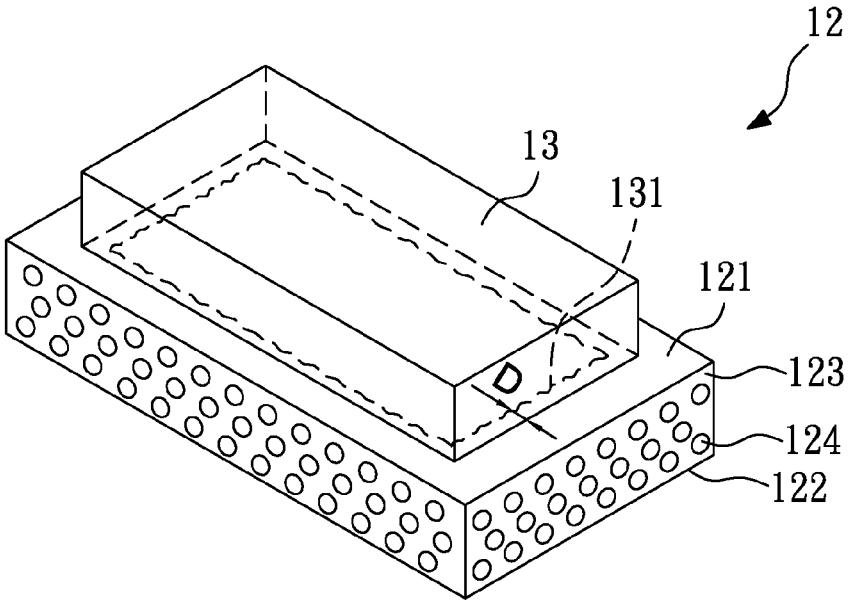
FIG. 2(Prior Art)
FIG. 2 is a schematic perspective view of the conventional sheet.
Figure 3:
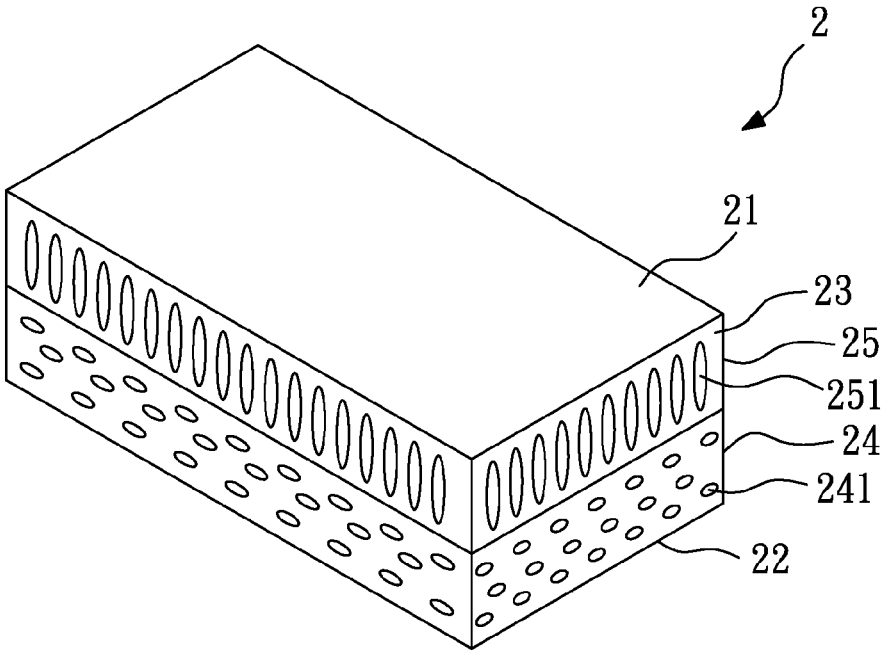
FIGS. 3 and 4 are schematic views of a method for making a sheet for mounting a workpiece according to a first embodiment of the present invention.
Figure 4:
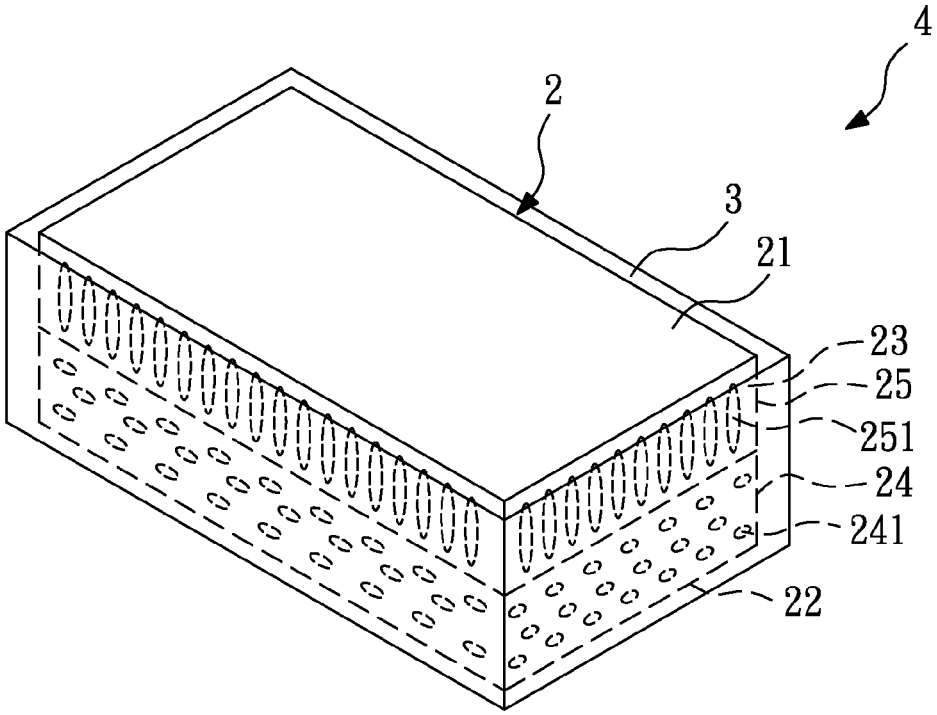

FIGS. 3 and 4 are schematic views of a method for making a sheet for mounting a workpiece according to a first embodiment of the present invention. First, referring to FIG. 3, a sheet body 2 is provided. The sheet body 2 has a top surface 21, a bottom surface 22, at least one side surface 23, and a plurality of pores (for example, first pores 241 and second pores 251). The top surface 21 is used for mounting a workpiece 13 (as shown in FIGS. 1 and 2), and the bottom surface 22 is attached to a table (for example, the lower base plate 11 in FIG. 1) when in use. The pores are located in the sheet body 2 and are communicating pores, some of which open at the side surface 23. In this embodiment, the sheet body 2 has four side surfaces 23; the top surface 21 is adjacent to the four side surfaces 23, wherein some of the pores open at the four side surfaces 23.

In this embodiment, the material of the sheet body 2 is resin, and the sheet body 2 has a double-layered structure. However, it should be understood that the sheet body 2 may also have a single-layered structure. The sheet body 2 includes a buffer layer 24 and a mounting layer 25, and the mounting layer 25 is located on the buffer layer 24, and is used for mounting the workpiece 13. The pores include a plurality of first communicating pores 241 and a plurality of second communicating pores 251. The first pores 241 are located at the buffer layer 24, and the second pores 251 are located at the mounting layer 25. The compression ratio of the buffer layer 24 is greater than that of the mounting layer 25. Preferably, the void content of the buffer layer 24 is greater than that of the mounting layer 25.

In this embodiment, the material of the buffer layer 24 is polyurethane (PU) resin, and the void content is greater than 60%, and preferably greater than 75%. The material of the mounting layer 25 is PU resin, polyvinyl chloride resin, polystyrene resin, polyethylene resin, polyamide resin, propylene resin, or ethylene-vinyl acetate resin, and the void content is 30%-60%, preferably 40%-50%. Additionally, the compression ratio of the buffer layer 24 is greater than 30%, and preferably greater than 50%, which may be adjusted according to requirements. The compression ratio of the mounting layer 25 is 25%-40%.

Next, referring to FIG. 4, pores that open at the side surface 23 are sealed or narrowed. In this embodiment, a sealing material 3 is formed on the side surface 23 to cover and seal the pores that open at the side surface 23 (for example, the first pores 241 and the second pores 251). The material of the sealing material 3 is silica gel, PU resin, or a hot melt adhesive. The sealing material 3 may completely cover the whole plane of the side surface 23 or merely cover part of the plane.

FIG. 4 is a schematic view of the sheet for mounting a workpiece according to the first embodiment of the present invention. The sheet 4 includes a sheet body 2 and a sealing material 3. The sheet body 2 has a top surface 21, a bottom surface 22, at least one side surface 23, and a plurality of pores (for example, the first pores 241 and the second pores 251). The top surface 21 is used for mounting a workpiece 13 (as shown in FIGS. 1 and 2), and the bottom surface 22 is attached to a table (for example, the lower base plate 11 in FIG. 1) when in use. The pores are located in the sheet body 2 and are communicating pores, some of which open at the side surface 23. In this embodiment, the sheet body 2 has four side surfaces 23, the top surface 21 is adjacent to the four side surfaces 23, and some of the pores open at the four side surfaces 23.

In this embodiment, the material of the sheet body 2 is resin, and has a double-layered structure. However, it should be understood that, the sheet body 2 may also have a single-layered structure. The sheet body 2 includes a buffer layer 24 and a mounting layer 25; the mounting layer 25 is located on the buffer layer 24 and is used for mounting the workpiece 13. The pores include a plurality of first pores 241 and a plurality of second pores 251. The first pores 241 are located at the buffer layer 24, and the second pores 251 are located at the mounting layer 25.

The sealing material 3 is located on the side surface 23 so as to cover and seal the pores that open at the side surface 23 (for example, the first pores 241 and the second pores 251). In this embodiment, the material of the sheet body 2 is resin, and the material of the sealing material 3 is silica gel, PU resin, or a hot melt adhesive.

Figure 5:
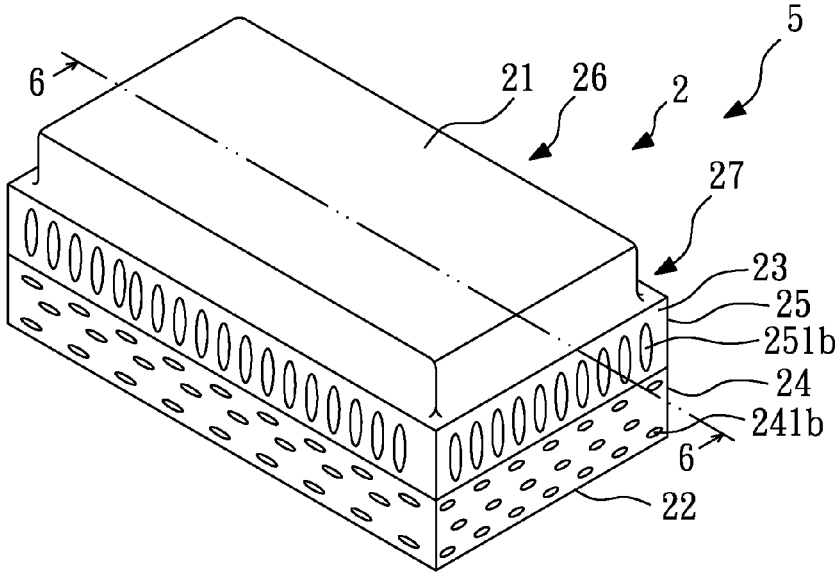
FIGS. 5 and 6 are schematic views of a method for making a sheet for mounting a workpiece according to a second embodiment of the present invention.
Figure 6:
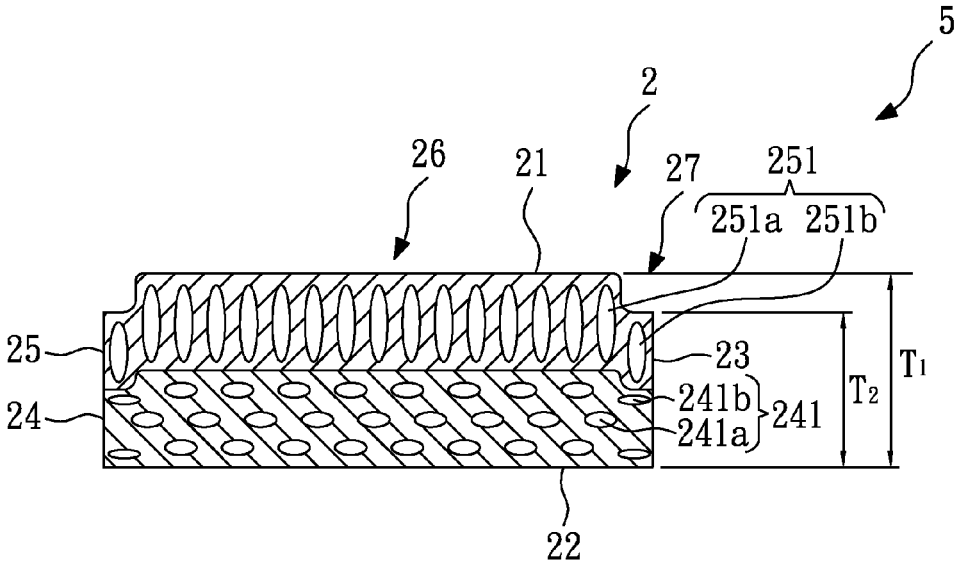

FIGS. 5 and 6 are schematic views of a method for making a sheet for mounting a workpiece according to a second embodiment of the present invention. First, a sheet body 2 is provided, as shown in FIG. 3. The sheet body 2 has a top surface 21, a bottom surface 22, at least one side surface 23, and a plurality of pores (for example, first pores 241 and second pores 251).

Next, referring to FIG. 5, the pores that open at the side surface 23 are sealed or narrowed. In this embodiment, a peripheral part 27 of the sheet body 2 is hot-pressed, such that the sheet body 2 is divided into a middle part 26 and at least one peripheral part 27, so as to seal or narrow the pores that open at the side surface 23. The hot-pressing method may be laser heating, heating layering, or heating platen, in which the heating temperature is 175° C., the pressure is 6 kg/cm$^2$, and the hot-pressing time is 30 seconds.

The middle part 26 has a first thickness $T_1$, a plurality of middle pores, and a first bulk density. The peripheral part 27 is located at the periphery of the middle part 26, and has a second thickness $T_2$, a plurality of peripheral pores, and a second bulk density. The second thickness $T_2$ is less than the first thickness $T_1$; preferably, the ratio of the second thickness to the first thickness ($T_2/T_1$) is less than 0.9. The second bulk density is greater than the first bulk density. The diameter of the peripheral pores is less than that of the middle pores.

In other embodiments, the pores that originally open at the side surface 23 are sealed completely, that is, the diameter of the peripheral pores is compressed to zero, and the peripheral pores disappear, such that the side surface 23 has no pores therein.

FIGS. 5 and 6 are respectively a schematic perspective view and a schematic cross-sectional view of the sheet for mounting a workpiece according to the second embodiment of the present invention. The sheet 5 includes a sheet body 2, and the sheet body 2 includes a middle part 26 and at least one peripheral part 27. The middle part 26 is a part that is not hot-pressed, and has a top surface 21, a first thickness $T_1$, and a first bulk density. The top surface 21 is used for mounting a workpiece 13 (as shown in FIGS. 1 and 2). The peripheral part 27 is a part that is hot-pressed, and is located at the periphery of the middle part 26. The peripheral part 27 has a side surface 23, a second thickness $T_2$, and a second bulk density. The second thickness $T_2$ is less than the first thickness $T_1$; preferably, the ratio of the second thickness to the first thickness ($T_2/T_1$) is less than 0.9. The second bulk density is greater than the first bulk density. In this embodiment, the first bulk density is 0.250 kg/cm$^3$, and the second bulk density is 0.650 kg/cm$^3$.

In this embodiment, the sheet body 2 has a double-layered structure, and includes a buffer layer 24 and a mounting layer 25. The mounting layer 25 is located on the buffer layer 24, and is used for mounting the workpiece 13 (as shown in FIGS. 1 and 2). The compression ratio of the buffer layer 24 is greater than that of the mounting layer 25. The buffer layer 24 has a plurality of first pores 241 (first middle pores 241*a* and first peripheral pores 241*b*). The mounting layer 25 has a plurality of second pores 251 (second middle pores 251*a* and second peripheral pores 251*b*). The middle pores (the first middle pores 241*a* and the second middle pores 251*a*) are located at the middle part 26. The peripheral pores (the first peripheral pores 241*b* and the second peripheral pores 251*b*) are located at the peripheral part 27. The diameter of the peripheral pores is less than that of the middle pores. That is, the diameter of the first peripheral pores 241*b* is less than that of the first middle pores 241*a*, and the diameter of the second peripheral pores 251*b* is less than that of the second middle pores 251*a*.

In this embodiment, the diameter of the peripheral pores (the first peripheral pores 241*b* and the second peripheral pores 251*b*) is less than 500 μm, and preferably less than 100 μm. The diameter of the middle pores (the first middle pores 241*a* and the second middle pores 251*a*) is about 1000 μm.

In this embodiment, some of the peripheral pores (the first peripheral pores 241*b* and the second peripheral pores 251*b*) open at the side surface 23 of the peripheral part 27, and the diameter is less than 500 μm, preferably less than 100 μm. However, in other embodiments, the pores that originally open at the side surface 23 are sealed completely; that is, the diameter of the peripheral pores (the first peripheral pores 241*b* and the second peripheral pores 251*b*) is compressed to zero, and the peripheral pores disappear, such that the side surface 23 has no pores therein.

In this embodiment, the number of the peripheral parts 27 is four, and the peripheral parts 27 surround the middle part 26. That is, the four side edges of the sheet body 2 are all hot-pressed.

The middle part 26 has a bottom surface, the peripheral part 27 has a bottom surface, and the bottom surface of the middle part 26 and the bottom surface of the peripheral part 27 are coplanar (that is, the bottom surface 22), and are attached to a table when in use (for example, the lower base plate 11 in FIG. 1).

An evaluation of the life of the sheet 5 and the conventional sheet 12 is shown in the table below.

| | Number of times an article is polished | | | | |
|---|---|---|---|---|---|
| | 5 times | 10 times | 15 times | 20 times | 25 times |
| Infiltration distance of the conventional sheet 12 | 0 cm | 0.1 cm | 0.3 cm | 0.3 cm | 0.4 cm |
| Infiltration distance of the sheet 5 | 0 cm | 0 cm | 0.1 cm | 0.1 cm | 0.2 cm |

As seen in the table above, under the same condition, the infiltration distance of the sheet 5 is less than that of the conventional sheet 12, which demonstrates that the effective life of the sheet 5 is longer than that of the sheet 12.

Figure 7:
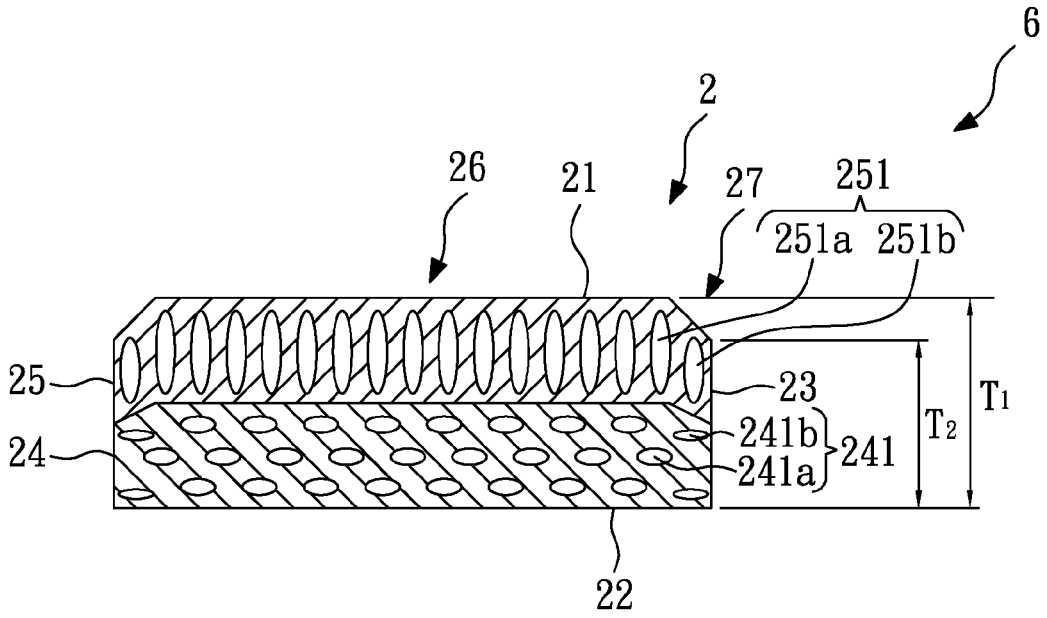
FIG. 7 is a schematic cross-sectional view of a sheet for mounting a workpiece according to a third embodiment of the present invention.

FIG. 7 is a schematic cross-sectional view of a sheet for mounting a workpiece according to a third embodiment of the present invention. The sheet 6 of this embodiment is substantially the same as the sheet 5 of the second embodiment (as shown in FIG. 6). The difference between this embodiment and the second embodiment lies in the shape of the peripheral part 27. In the second embodiment, the peripheral part 27 has a uniform thickness, and forms a step shape with the middle part 26. In this embodiment, the peripheral part 27 has a tapered shape.

Figure 8:
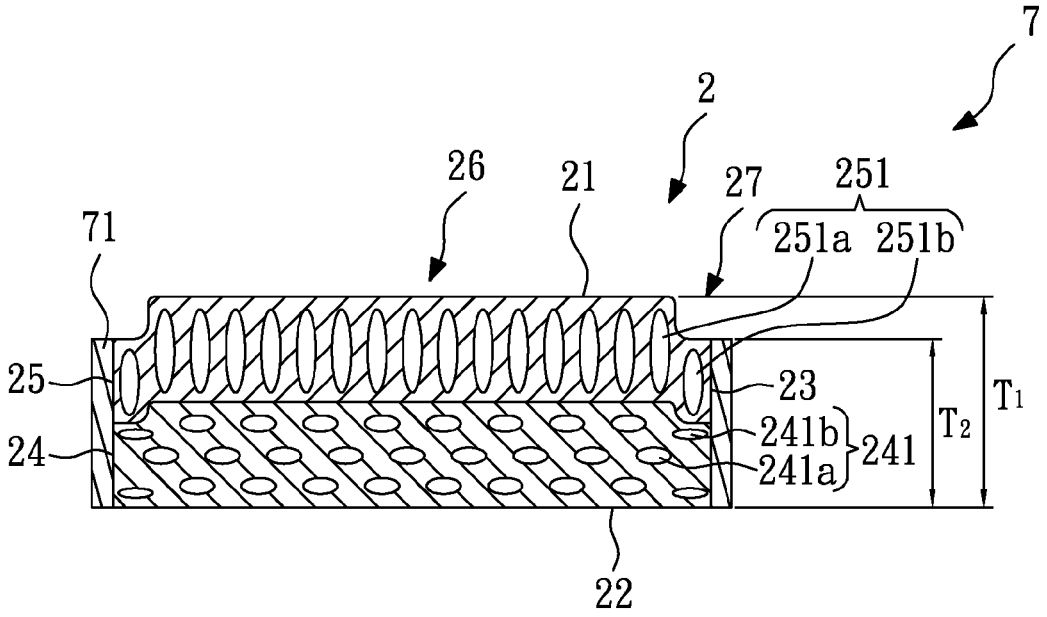
FIG. 8 is a schematic cross-sectional view of a sheet for mounting a workpiece according to a fourth embodiment of the present invention.

FIG. 8 is a schematic cross-sectional view of a sheet for mounting a workpiece according to a fourth embodiment of the present invention. The sheet 7 of this embodiment is substantially the same as the sheet 5 of the second embodiment (as shown in FIG. 6). The difference between this embodiment and the second embodiment lies in that the sheet 7 further includes a sealing material 71 located on the side surface 23 of the peripheral part 27. The material of the sheet body 2 is resin, and the material of the sealing material 71 is silica gel, PU resin, or a hot melt adhesive. The sealing material 71 may be formed on the side surface 23 of the peripheral part 27 after the sheet body 2 is hot-pressed, or may be formed on the side surface 23 of the sheet body 2 before hot-pressing.

In the present invention, since the pores that open at the side surface 23 are sealed or narrowed, the slurry 16 is prevented from entering into the interior of the sheet body 2 during the polishing process. Therefore, the infiltration distance D reaches the predetermined value (of about 1 cm or 2 cm) slowly, thereby extending the effective life of each of the sheets 4, 5, 6, 7. Furthermore, the sheets 4, 5, 6, 7 are composite sheets formed by two different layers, which thus have suitable hardness and compression ratio. Moreover, the hardness and the compression ratio may be adjusted according to requirements. In other words, as compared with the conventional single-layered sheet 12, the composite sheet of the present invention has better mounting effect due to lower hardness and better buffering effect due to greater compression ratio.

While several embodiments of the present invention have been illustrated and described, various modifications and improvements can be made by those skilled in the art. The embodiments of the present invention are therefore described in an illustrative but not restrictive sense. It is intended that the present invention should not be limited to the particular forms as illustrated, and that all modifications which maintain the spirit and scope of the present invention are within the scope defined in the appended claims.

What is claimed is:

1. A method for making a sheet for mounting a workpiece, comprising:

(a) providing a sheet body having a top surface, a bottom surface, four side surfaces, and a plurality of pores, wherein some of the pores open at the four side surfaces, and the top surface is adjacent to the side surfaces, the sheet body comprises a buffer layer and a mounting layer, the mounting layer is located on the buffer layer and is used for mounting a workpiece, the pores comprise a plurality of first pores and a plurality of second pores, the first pores are located at the buffer layer, the second pores are located at the mounting layer, and the compression ratio of the buffer layer is greater than that of the mounting layer; and (b) sealing or narrowing the pores that open at the four side surfaces, wherein a peripheral part of the sheet body is hot-pressed, so as to divide the sheet body into a middle part and at least one peripheral part, the middle part has a first thickness and a first bulk density, the peripheral part is located at the periphery of the middle part, the peripheral part has a second thickness and a second bulk density, the second thickness is less than the first thickness, and the second bulk density is greater than the first bulk density.

2. The method according to claim 1, wherein in step (b), a sealing material is formed on the side surface, so as to cover and seal the pores that open at the side surface.

* * * * *